United States Patent [19]

Ahmad et al.

[11] Patent Number: 4,471,587

[45] Date of Patent: Sep. 18, 1984

[54] DUAL SWING-UP ELEVATOR WELL DRILLING APPARATUS

[75] Inventors: Hafizuddin Ahmad; Turdsak Vorarittinapa, both of Houston, Tex.

[73] Assignee: Continental Emsco, Dallas, Tex.

[21] Appl. No.: 350,707

[22] Filed: Feb. 22, 1982

[51] Int. Cl.[3] ..... B66C 23/62; E04B 1/00

[52] U.S. Cl. ..... 52/120; 52/741

[58] Field of Search ..... 52/116, 117, 118, 119, 52/120, 741, 747; 254/284, 285, 286, 336, 337, 338

[56] References Cited

U.S. PATENT DOCUMENTS

| | | | |
|---|---|---|---|
| 3,228,151 | 1/1966 | Woolslayer et al. | 52/64 |
| 3,262,237 | 7/1966 | Jenbins et al. | 52/116 |
| 3,483,933 | 12/1969 | Dyer et al. | 52/116 |
| 3,494,593 | 2/1970 | Blogg | 52/116 |
| 3,749,183 | 7/1973 | Brahnham et al. | 173/151 |
| 3,803,780 | 4/1974 | Donnally | 52/116 |
| 3,807,109 | 4/1974 | Jenkins et al. | 52/120 |
| 3,922,825 | 12/1975 | Eddy et al. | 52/116 |
| 4,375,241 | 3/1983 | Gallon | 52/116 |

FOREIGN PATENT DOCUMENTS

| | | | |
|---|---|---|---|
| 554672 | 3/1958 | Canada | 52/120 |

OTHER PUBLICATIONS

Dreco "Slingshot" brochure, on front cover indicates patent pending, 1980.

*Primary Examiner*—John E. Murtagh
*Assistant Examiner*—Andrew Joseph Rudy
*Attorney, Agent, or Firm*—Thomas F. Daley

[57] ABSTRACT

A well drilling apparatus includes a first swing-up elevator platform on which the mast structure is pivotally mounted. After the mast structure has been raised to its erect position, the first elevator platform is elevated to carry the mast structure to a high operational level. A second swing-up elevator platform is provided to carry the drawworks to the same high level at which the two elevator platforms are coupled together to form the working floor. All of the raising and elevating operations can be accomplished with power supplied by the drawworks. The elevator platforms may be lowered after the drilling operation has been accomplished without interfering with any control valve structures that have been placed on the wellhead while the structure was at its raised operational level; the swing-up elevator platforms swing down in opposite directions over any such valve structure.

19 Claims, 7 Drawing Figures

DUAL SWING-UP ELEVATOR WELL DRILLING APPARATUS

This invention relates to well drilling apparatus and more particularly to a dual swing-up elevator apparatus for drilling oil and gas wells or the like.

BACKGROUND OF THE INVENTION

It is desirable to provide a well drilling apparatus for drilling oil and gas wells or the like, in which the component parts can be assembled at substantially ground level and then raised to a high elevation where they are operational and in which all of the raising operations can be accomplished with power supplied by the drawworks. Several such apparatus have been proposed in the prior art. Woolslayer et al (U.S. Pat. No. 3,228,151), for example, teach a complicated oil drilling apparatus in which either the rotary table is carried by the mast, or in which the mast has short rear legs and front legs pivoted to the base. A single elevator platform is utilized to carry the drawworks to its operational position. Branham et al (U.S. Pat. No. 3,749,183) teach a mast structure which is pivotally mounted on a base and which includes a single elevator platform for carrying the drawworks to its operational position. The Branham et al structure further requires a separate pivotal pipe rack which is separately mounted on the base and pivoted into position and a rotary table platform which must be lifted to platform level and connected between the elevated drawworks platform and pipe rack. Donnally (U.S. Pat. No. 3,803,780) teaches a particular form of collapsible ginpole to which a mast structure is pivotally mounted. The Donnally structure has a single elevator platform for raising the drawworks and requires assembly of a working floor support and working floor after the mast structure has been lifted into position and the ginpole collapsed. Jenkins et al (U.S. Pat. No. 3,807,109) teach a ginpole carried by an elevator drawworks platform. The mast structure is pivotally mounted on a reclining setback support member, which, in turn, is pivotally mounted on the base. None of the above show or suggest a mast structure pivotally mounted on an elevator platform.

Dreco, Inc. manufactures a self-elevating "Slingshot" structure which raises from ground level to drilling position utilizing hydraulically driven winches (separate from the drawworks) mounted in each base assembly. The Dreco structure includes a single elevator platform carrying the mast structure, rotary table, drawworks and setback area. In addition to requiring separate winches (making the structure extremely expensive), the Dreco single elevator platform structure has proven extremely difficult in field use; the single platform cannot be lowered without interfering with certain control valve structures (such as the control valve structures commonly referred to as "Christmas trees") required to be placed on wellheads to control gas pressures and the like while the platform is still in its elevated position.

It is therefore an object of the present invention to provide an improved oil and gas drilling apparatus.

Another object of the invention is to provide an improved drilling apparatus wherein the drawworks and mast can be assembled onto the base structure at ground level and then raised to an elevated operating position.

Yet another object of the invention is to provide a simplified drilling apparatus, the component parts being assemblable at ground level and then raisable to a high operational elevation, in which all of the raising operations can easily be accomplished with power supplied by the drawworks.

Still another object of the invention is to provide a well drilling apparatus in which the drawworks and mast structure can be lowered by elevator or platform means without interfering with any control valve structures placed on the wellhead while the well drilling apparatus is in its raised operational position.

These and other objects are accomplished in accordance with the present invention in which a first swing-up elevator platform on which the mast structure is pivotally mounted is provided for elevating the mast structure to a high operational level after the mast structure has been raised to its erect position; and, a second swing-up elevator platform is provided to carry the drawworks to the same high level at which the two elevator platforms are coupled together to form the working floor. All of the raising and elevating operations can be accomplished with power supplied by the drawworks. The elevator platforms may be lowered after the drilling operation has been accomplished without interfering with any control valve structures that have been placed on the wellhead while the structure was at its raised operational level, because the swing-up elevator platforms swing down in opposite directions over any such valve structure.

In one embodiment of the invention, a drawworks swing-up elevator platform is mounted on a base structure and a mast-setback swing-up elevator platform is also mounted on the base structure. The elevators swing up from either end of the base and meet near the center of the base. The front legs of a mast are pivotally mounted on the mast-setback elevator platform along with a mast ginpole. The rotary table is mounted in the mast-setback elevator platform and forms part of the mast-setback elevator. A second elevator or ginpole is mounted on the base structure. The mast structure is raised to an erect or vertical position, utilizing the mast ginpole and drawworks. The mast ginpole provides the rear legs of the mast structure once the mast structure has been raised to the vertical position. The drawworks is then utilized in conjunction with the elevator ginpole to raise the mast-setback elevator platform up to its elevated operational position and the mast-setback elevator platform is coupled to the elevator ginpole. The drawworks then utilizes the elevator ginpole to raise the drawworks elevator platform up to the same elevated level as the mast-setback elevator where the front end of the drawworks elevator platform meets the rear end of the mast-setback elevator platform. The drawworks elevator platform is then coupled to the mast-setback elevator, or alternatively, to the elevator ginpole to lock it into operational position. The mast-setback elevator platform is sufficiently large to provide the working floor and includes the setback area of the drilling apparatus.

BRIEF DESCRIPTION OF THE DRAWINGS

Still further objects and advantages of the invention will be apparent from the detailed description and claims when read in conjunction with the accompanying drawings wherein:

DETAILED DESCRIPTION OF A PREFERRED EMBODIMENT

Figure 1:
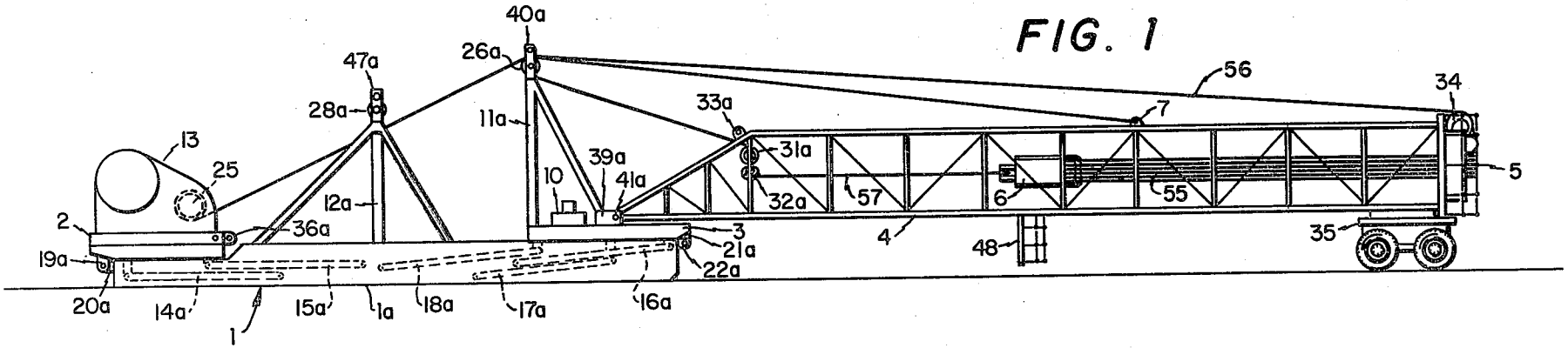
FIG. 1 is a driller side elevation of a well drilling apparatus in accordance with an embodiment of the present invention in its field assembly position with the lines strung to pivot the mast to its vertical operational position.
Figure 2:
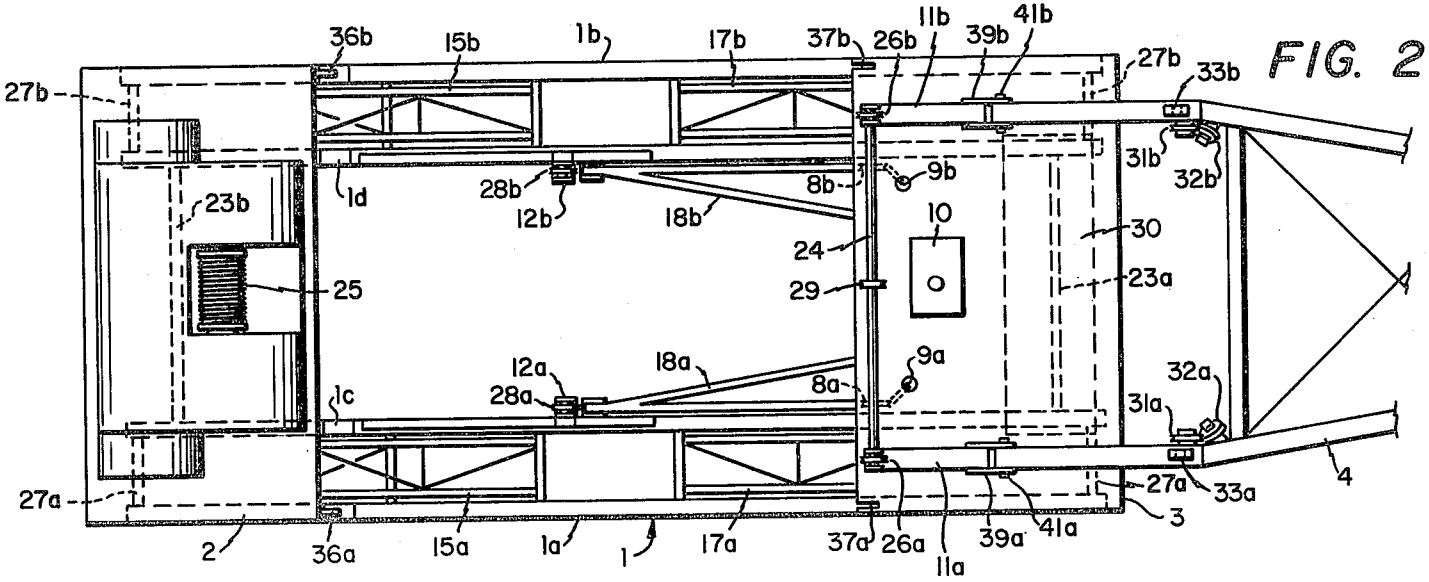
FIG. 2 is a plan view of the base and elevator platforms of the well drilling apparatus of FIG. 1.
Figures 3, 6:
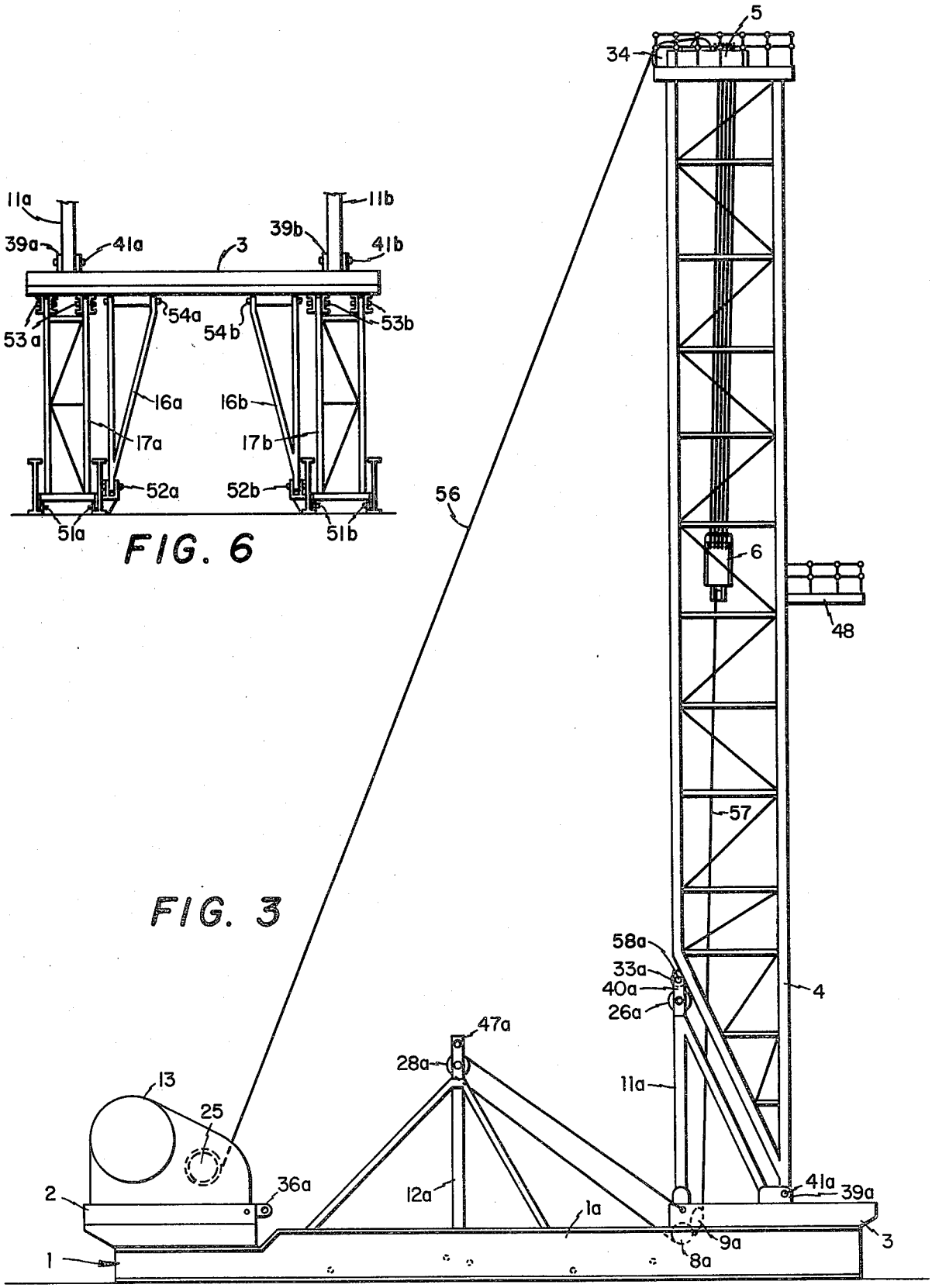
FIG. 3 is a driller side elevation of the well drilling apparatus of FIG. 1 showing the mast raised to its vertical position and the lines restrung for lifting of the mast-setback elevator platform to its operational level.
FIG. 6 is a front elevation showing the elevator substructure in further detail.
Figure 4:
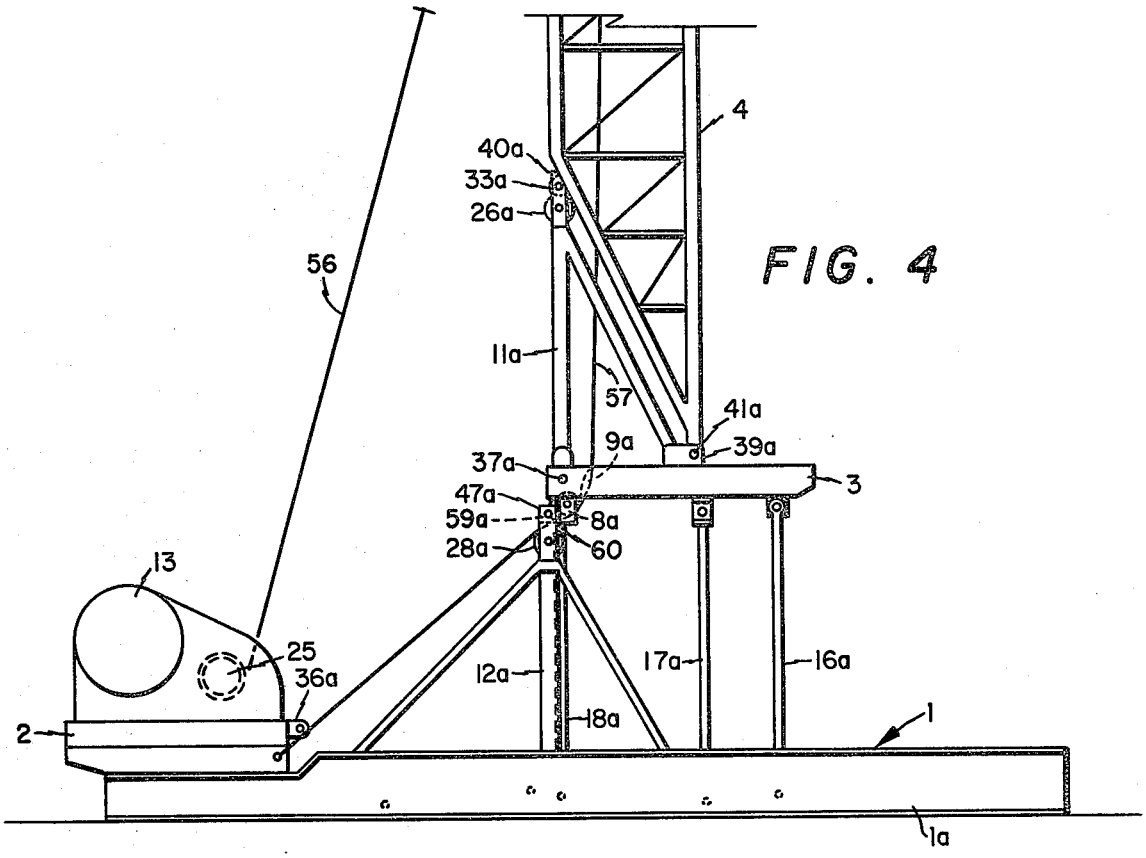
FIG. 4 is a driller side elevation of the apparatus of FIG. 1 with the mast-setback elevator platform raised to its operational level and the lines restrung to raise the drawworks elevator platform to the same operational level.

Referring to the drawings, it should be noted that the various parts have been numbered with "a" on the driller's side while parts on the opposite side of the apparatus have been numbered with a "b". In some instances, parts will be numbered and shown only on the driller's side, it being recognized by the reader that the respective part on the opposite side of the apparatus referred to in the description is merely a mirror image of the part shown in the drawings. Referring now to FIGS. 1, 2 and 6, a well drilling apparatus in accordance with an embodiment of the present invention is shown in its field assembly position. Base 1 is comprised of four skid members 1*a*–1*d*. Outer skid member 1*a* is connected to inner skid member 1*c* by means of transverse beams 27*a* located at the front and rear ends and various intermediate locations as required and outer skid member 1*b* is connected to inner skid member 1*d* by means of transverse beams 27*b* located at the front and rear ends and various intermediate locations as required. Inner beams 1*c* and 1*d* are connected together by means of spreader beams 23*a* and 23*b* located at the front and rear ends thereof, respectively. Seated on the rear portion of base 1 is a first swing-up elevator platform 2 for carrying drawworks 13 mounted on the upper surface thereof, from its low assembly position shown in FIG. 1 to its elevated operational position shown in FIG. 5. Seated in the front position of base 1 is a second swing-up elevator platform 3 for carrying mast structure 4 and ginpoles 11*a* and 11*b* from the assembly position shown in FIG. 1 to its elevated operational level after mast structure 4 has been raised to its vertical position as shown in FIG. 4. Also seated in the base are second ginpoles 12*a* and 12*b*. Elevator platform 3 also includes a setback area 30, rotary table 10 and sufficient working floor for the drilling personnel.

Drawworks elevator platform 2, as it shall be referred to herein, is connected to base 1 by means of parallel front and rear pairs of pivotal leg members 15*a*, 15*b* and 14*a*, 14*b*, respectively, extending lengthwise of base 1. Mast-setback elevator platform 3, as it shall be referred to herein, is connected to base 1 by means of parallel front and rear pairs of pivotal legs 16*a*, 16*b* and 18*a*, 18*b*, respectively, and a center pair of legs 17*a*, 17*b*. Legs 14*a*, 14*b*, 15*a*, 15*b* and 17*a*, 17*b* are virtually identical and, as shown in FIG. 1, are connected to the base at longitudinally spaced points, while the rear ends of these legs are pivotally connected to the under side of the respective elevator platforms 2 and 3 at longitudinally spaced points. Legs 16*a*, 16*b* and 18*a*, 18*b* are virtually identical to each other and are connected to the base at longitudinally spaced points as can also be seen in FIG. 1.

Referring to FIG. 6, leg 17*a*, is shown connected to base members 1*a* and 1*c*, and leg 17*b* is shown connected to base members 1*b* and 1*d* by means of pins 51*a* and 51*b*, respectively. Legs 14*a*, 14*b* and 15*a*, 15*b* are connected to base members 51*a* and 51*b* in a similar manner. Legs 16*a* and 16*b* are shown connected to base members 1*c* and 1*d* by means of pin members 52*a* and 52*b*, respectively. Legs 18*a* and 18*b* are connected to base members 51*a* and 51*b* in a similar manner. Legs 14*a*, 14*b*, 15*a*, 15*b*, and 17*a*, 17*b* are connected to the underside of the respective elevator platforms 2 and 3 by means of pins 53*a* and 53*b*, as illustrated in FIG. 6 for legs 17*a* and 17*b*. Legs 16*a*, 16*b* and 18*a*, 18*b* are connected to the underside of elevator platform 3 by means of pins 54*a* and 54*b*, respectively as shown for legs 16*a* and 16*b* in FIG. 6. When at the low assembly elevation, the elevator platforms 2 and 3 are easily deposited on base 1 and readily connected to it by means of the reclining legs.

Located on the upper surface of mast-setback elevator platform 3 is a pair of shoe bracket members 39*a*, 39*b* that pivotally support the front feet of reclining mast member 4 which extends forward away from base 1. The mast is moved into position by a suitable truck 14 and trailer (not shown), so that connection to setback elevator platform 3 is easy to make by insertion of pins 41*a*, 41*b* through bracket members 39*a*, 39*b*, and the respective front feet of the mast which have been located in brackets 39*a*, 39*b*.

Referring to FIG. 1, mast 4 contains a traveling block 6, which is connected by lines 55 to crown block 5 at the head of the mast from which the fast line 56 extends in the usual manner over sheave 34 and sheave 29 to drum 25 of drawworks 13. Sheave 29 is supported by spreader beam 24 which extends between mast ginpoles 11*a* and 11*b*. In order to raise mast 4 to its vertical position, a sling line 57 is looped over the hook of traveling block 6, as shown in FIG. 1, and the opposite ends of the line respectively extend over sheaves 32*a*, 32*b*, over sheaves 31*a*, 31*b*, over ginpole sheaves 26*a*, 26*b*, and are connected to anchor brackets 7 located on either side of mast 4.

In order to raise mast 4, drawworks 13 is operated to pull traveling block 6 toward crown block 5. As shown in FIG. 3, this pulls mast 4 backward toward ginpoles 11*a*, 11*b* and causes it to pivot along the axis provided by pins 41*a*, 41*b* to an upright position; in this position, brackets 33*a*, 33*b* on its back side are pinned by means of pins 58*a*, 58*b* to brackets 40*a*, 40*b* located at the top of ginpoles 11*a*, 11*b*, respectively, to hold mast 4 firmly in place in the raised vertical position.

During the mast raising operation, elevator platform 2 is anchored to base 1 by means of a pin inserted through brackets 19*a*, 19*b*, and 20*a*, 20*b*, and elevator platform 3 is anchored to base 1 by means of pins inserted through brackets 21*a*, 21*b* located on the elevator and 22*a*, 22*b* located on base 1.

The sling line is then disconnected from bracket member 7 and reconnected as illustrated in FIG. 3. Opposite ends of sling line 57, which is looped over the hook of traveling block 6, are now extended through openings on opposite sides of elevator platform 3, over sheaves 9*a*, 9*b*, over sheaves 8*a*, 8*b*, over ginpole sheaves 28*a*, 28*b* and connected to opposite sides of platform 3 as shown in FIG. 3. The pins are removed from brackets 21*a*, 21*b* and 22*a*, 22*b* to free elevator platform 3 from base 1. Drawworks 13 is then operated to pull traveling block 6 toward crown block 5 to raise and swing mast-setback elevator platform 3 upwardly and back on its pivotal supporting legs 16*a*, 16*b*, 17*a*, 17*b*, 18*a*, 18*b* to its elevated position shown in FIG. 4. Pins 60 are then inserted through bracket members 59*a*, 59*b* located on the lower portion of sheaves 8*a*, 8*b* support members affixed to the underside of elevator platform 3 and bracket members 47*a*, 47*b* located at the top of ginpoles 12*a*, 12*b*. Pins 60 firmly secure mast-setback elevator platform 3 to ginpoles 12*a*, 12*b*.

Figure 5:
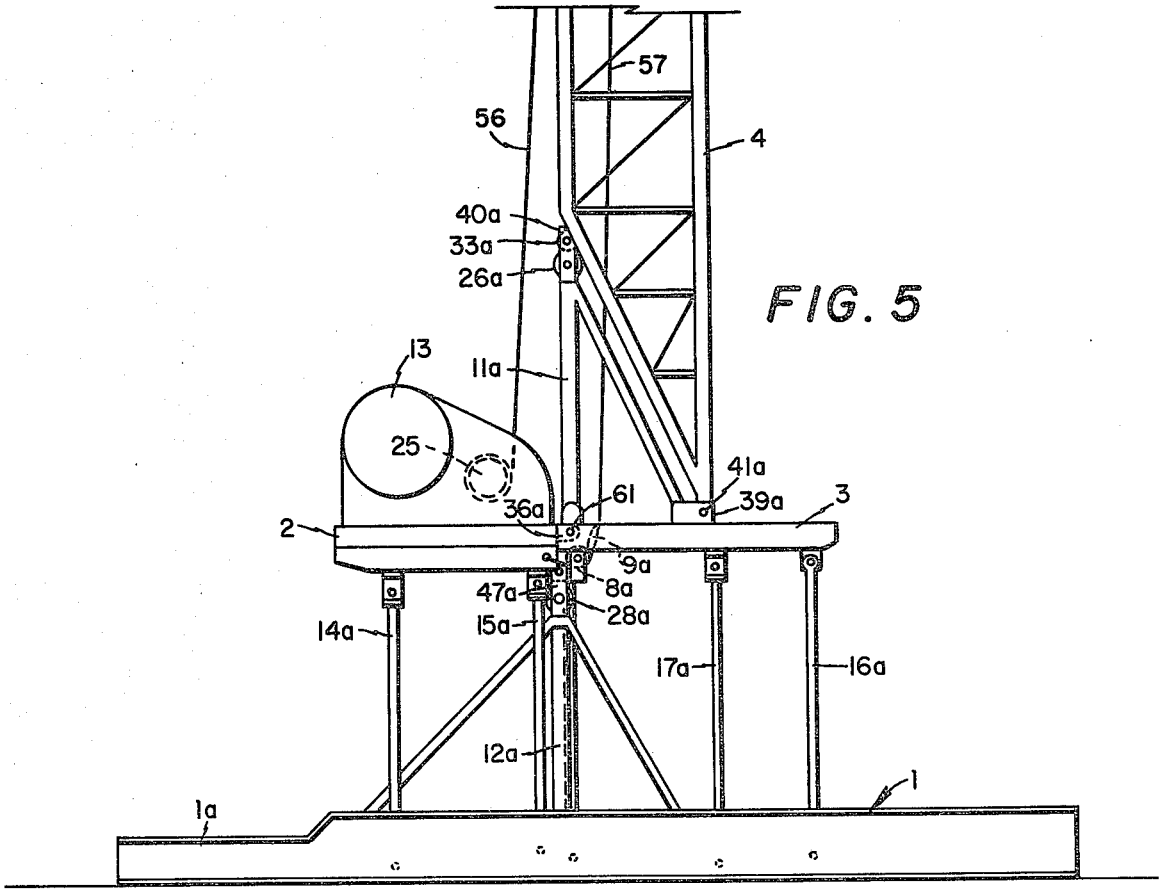
FIG. 5 is a driller side elevation of the well drilling apparatus of FIG. 1 with the drawworks elevator platform raised to its operational level and coupled to the mast-setback elevator platform.

The sling line is then disconnected and reconnected as illustrated in FIG. 4 such that opposite ends of the line from the hook of traveling block 6 pass through the openings located on either side of platform 3, over sheaves 9*a*, 9*b*, and sheaves 8*a*, 8*b*, over elevator ginpole sheaves 28*a*, 28*b* and are connected on opposite sides of drawworks elevator platform 2. Drawworks elevator platform 2 is then disconnected from base 1 by removal of the pins extending through brackets 19*a*, 19*b*, and 20*a*, 20*b*, used to hold elevator platform 2 fixed to base 1 during the mast raising operations. Drawworks 13 is then operated to raise and swing drawworks elevator platform 2 upwardly and forward to its raised position on its pivotal supporting legs 14*a*, 14*b*, 15*a*, 15*b*, as shown in FIG. 5. Pins 61 are then inserted through openings on either side of platform 3 and through openings in brackets 36*a*, 36*b* located on the front side of platform 2 which extend into slots 37*a*, 37*b* of elevator platform 3 when both platforms are in the high elevated position. The sling is then disconnected from elevator platform 2. Assembly of the drilling apparatus is thus complete and the apparatus is ready for operation.

Figure 7:
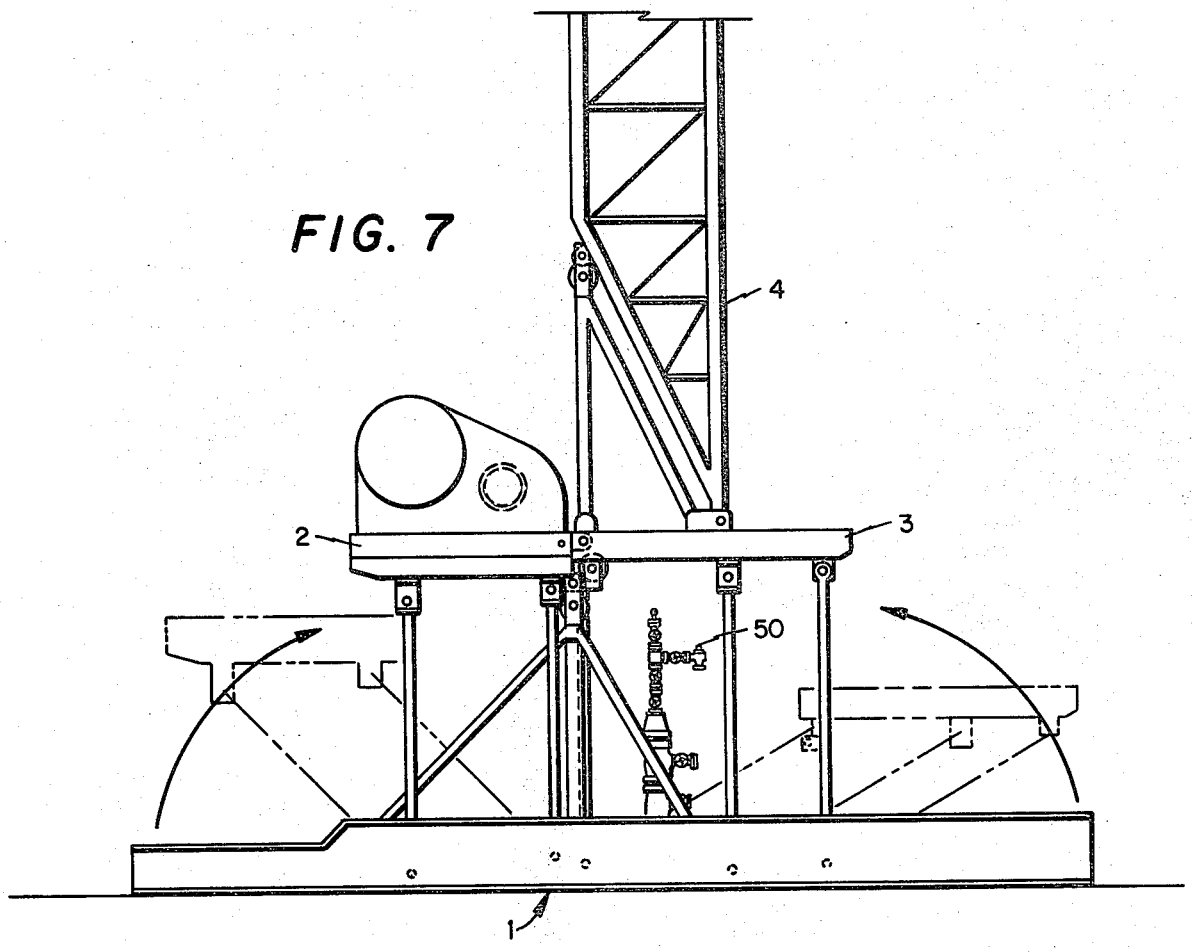
FIG. 7 is a driller side elevational view of the well drilling apparatus of FIG. 5 on a completed well in which a "Christmas tree" type control valve structure has been mounted on the wellhead and illustrating the lowerability of the elevator platforms without interfering with the control valve structure.

After completion of the well it is required to place a set of control valves 50 including a Christmas tree, for example, over the wellhead as illustrated in FIG. 7. FIG. 7 shows the arc of the elevator platforms 2 and 3 as they are easily lowered over and outwardly of valve structure 50, without interfering therewith.

An embodiment of the invention including the various features thereof has now been described in detail. It should be understood, however, that the foregoing description is illustrative of the inventive concepts; various modifications may be made to the details without departing from the spirit of the invention and, within the scope of the appended claims, the invention may be practiced otherwise than as specifically illustrated and described.

What is claimed is:

1. A well drilling apparatus comprising:

(a) a base having opposite ends;

(b) a second swing-up elevator platform mounted on said base toward one end thereof, said first elevator platform being adapted for carrying a mast structure from an initial reclining position to a raised operational level, said mast structure being attached to and pivotally mounted on said first elevator platform and said first elevator platform including a first ginpole means that is in a fixed position relative to said mast structure and that is adaptive for raising said mast structure from its initial reclining assembly position to an upright position;

(c) a first swing-up elevator platform mounted on said base toward the opposite end thereof, said first and second elevator platforms being adapted to be raised from an initial assembly level to a higher operational level;

(d) said base including a second ginpole means that is adaptive for raising said first and second elevator platforms from said initial assembly level to the raised operational level;

(e) said mast structure including a traveling block mounted therein, a fast line supported by said mast structure and connected to said block at one end and at its other end to a drawworks means for pulling said block toward the head of said mast structure, and a sling line connected at one end to the traveling block at a point opposite said fast line; and (f) said sling being connectable via said first ginpole means to said mast structure such that said mast structure is raised from a reclining assembly position to an upright operational position when said drawworks means is operated, and separately connectable to said second ginpole means so as to separately swing up said first and second swing-up elevator platforms when said drawworks means is operated.

2. The apparatus according to claim 1 wherein said first elevator platform includes a rotary table mounted thereon.

3. The apparatus according to claim 1 wherein said first elevator platform includes a setback area.

4. The apparatus according to claim 1 wherein said second ginpole includes bracket means for securing said first elevator platform thereto.

5. The apparatus according to claim 1 wherein said first platform includes means for securing said second elevator platform thereto.

6. The apparatus according to claim 1 wherein said second ginpole includes bracket means for securing said second elevator platform thereto.

7. A well drilling apparatus comprising:

(a) a base having front and rear ends;

(b) a first set of parallel reclining front and rear legs extending lengthwise of the base;

(c) means pivotally connecting the rear end of each leg of said first set to longitudinally spaced points on the front portion of said base;

(d) a first elevatable platform member;

(e) means pivotally connecting the front ends of each leg of said first set to longitudinally spaced points on said first elevatable platform member;

(f) a reclining, forwardly extending mast structure having a front foot end pivotally connected to said first elevatable platform member and a head at the forward end thereof;

(g) a first ginpole means mounted on said first elevatable platform member for swinging said mast structure upwardly and rearwardly on its front foot end to an upright position;

(h) a second set of parallel reclining front and rear legs extending lengthwise of the base;

(i) means pivotally connecting the front end of each leg of said second set to longitudinally spaced points on the rear portion of said base;

(j) a second elevatable platform member;

(k) means pivotally connecting the rear end of each leg of said second set to longitudinally spaced points on said second elevatable platform member;

(l) second ginpole means mounted on said base for swinging said first elevatable platform member upwardly and rearwardly on said first set of legs to a raised position and for swinging said second elevatable platform member upwardly and forwardly on said second set of legs to a raised position;

(m) said mast structure including a traveling block, a fast line supported by the mast structure and connected at one end to said traveling block and at the other end to a drawworks means such that said traveling block is pulled toward the head of said mast structure when said drawworks means is operated;

(n) a sling connected at one end with said traveling block on a side opposite said fast line and at its other end via said first ginpole means to said mast structure so as to swing said mast structure upwardly and rearwardly on its front foot end to an upright position, said first ginpole means being connectable to and thereby providing a rear foot for said mast structure;

(o) means for separately connecting said sling via said second ginpole means with said first elevatable platform member for swinging said first platform member upwardly and rearwardly on said first set of legs to a raised position, said second ginpole means being connectable to said first platform means for maintaining said first platform means in said raised position; and (p) means for separately connecting said sling via said second ginpole means to said second elevatable platform member for swinging said second platform member upwardly and forwardly on said second set of legs to a raised position, the front end of said second platform member being connectable to the rear end of said first platform member, the upper surfaces of said first and second platform members forming a level working floor of the well drilling apparatus.

8. The apparatus according to claim 7 including:

means for securing said first elevatable platform member in said raised position and means for securing said second elevatable platform in said raised position.

9. The apparatus according to claim 8 wherein said means for securing said first elevatable platform member in said raised position includes means for connecting said first platform member to said second ginpole means.

10. The apparatus according to claim 8 wherein said means for securing said second elevatable platform member in said raised position includes means for connecting said second platform member to said first platform member.

11. The apparatus according to claim 7 including a drawworks mounted on said second elevatable platform member.

12. The apparatus according to claim 11 wherein said drawworks is mounted on said second platform member in the lowered position and carried to working floor level by said second platform member.

13. The apparatus according to claim 7 including means temporarily immovably connecting said first and second elevator platform members to said base during said mast raising operation.

14. The apparatus according to claim 7 including means temporarily connecting said second elevator platform member immovably to said base during the raising of said first elevator platform member.

15. The apparatus according to claim 7 including a rotary table mounted on said first elevatable platform member.

16. The apparatus according to claim 7 wherein said first platform member includes a setback area for said well drilling apparatus.

17. The apparatus according to claim 7 wherein said first set of parallel reclining legs includes center legs parallel to the front and rear legs to provide additional support for said first elevatable platform member.

18. A method of erecting a drilling apparatus having a base with front and rear ends, first and second swing-up elevator platform members initially positioned at a lower assembly level and a reclining mast structure pivotally mounted on said first elevator platform member comprising the steps of:

(a) pulling on a sling line when it is looped through a first ginpole and attached to said mast structure such that said mast structure is moved upwardly and rearwardly about its pivotal mounting point to an upright position;

(b) securing said mast member to said first ginpole member mounted on said first elevator platform;

(c) swinging said first platform member upwardly and rearwardly to a raised elevation by pulling on said sling line when it is looped through a second ginpole and attached to said first platform member;

(d) securing said first platform member to said second ginpole at said raised elevation;

(e) swinging said second platform member upwardly and forwardly such that the front of the second platform member meets the rear of said first platform member at said raised elevation by pulling on said sling line when it is looped through a second ginpole and attached to said second platform member;

(f) securing said second platform member at said raised elevation.

19. A method of erecting a well drilling apparatus having a base, first and second swing-up elevator platforms pivotally connected to the base and initially positioned at a lower assembly level, a reclining mast member pivotally mounted at its foot end on said first platform, a first ginpole means mounted on said first platform, a rotary table mounted on said first platform a drawworks mounted on said second platform, a traveling block mounted in the mast structure and supported by a fast line slung over the top of said mast structure and connected to said drawworks, a second ginpole mounted on the base, and a sling line connected at one end with the traveling block opposite the first line, comprising the steps of:

(a) connecting the other end of the sling line over a sheave on said first ginpole means to said mast structure;

(b) operating said drawworks to pull said traveling block toward the top of said mast structure, said sling line forcing said mast structure to swing upwardly and rearwardly about its pivotal mounting point to an upright position;

(c) securing said mast structure to said first ginpole means;

(d) reconnecting said other end of the sling line over sheaves mounted on said second ginpole means to said first platform;

(e) operating said drawworks to pull said traveling block toward the top of the mast structure, said sling line forcing said first platform to swing upwardly and rearwardly on its legs to a raised position;

(f) securing said first platform to said second ginpole means to maintain said first platform in said raised position;

(g) reconnecting said other end of the sling line over sheaves mounted on said second ginpole means to said second platform;

(h) operating said drawworks to pull said traveling block toward the top of the mast structure, said sling line forcing said second platform to swing upwardly and forwardly on its legs to a raised position; and (i) securing said second platform to said first platform to maintain said second platform in said raised position.

* * * * *